US008105033B2

(12) United States Patent
Hudson

(10) Patent No.: US 8,105,033 B2
(45) Date of Patent: Jan. 31, 2012

(54) PARTICLE RESISTANT IN-WALL COOLING PASSAGE INLET

(75) Inventor: Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 899 days.

(21) Appl. No.: 12/133,558

(22) Filed: Jun. 5, 2008

(65) Prior Publication Data

US 2009/0324425 A1 Dec. 31, 2009

(51) Int. Cl.
*F01D 5/08* (2006.01)

(52) U.S. Cl. ..... 416/97 R

(58) Field of Classification Search ..... 416/95, 416/96 R, 97 R, 97 A
See application file for complete search history.

(56) References Cited

U.S. PATENT DOCUMENTS

| | | | | |
|---|---|---|---|---|
| 5,340,278 | A * | 8/1994 | Magowan | 416/96 R |
| 5,498,133 | A * | 3/1996 | Lee | 416/97 R |
| 6,287,075 | B1 * | 9/2001 | Kercher | 416/97 R |
| 6,769,866 | B1 * | 8/2004 | Kannefass et al. | 415/115 |
| 6,773,230 | B2 * | 8/2004 | Bather et al. | 416/97 R |
| 7,845,906 | B2 * | 12/2010 | Spangler et al. | 416/97 R |
| 2007/0116569 | A1 * | 5/2007 | Cunha et al. | 416/97 R |
| 2008/0163604 | A1 * | 7/2008 | Spangler | 60/39.83 |

* cited by examiner

*Primary Examiner* — Matthew W Such
(74) *Attorney, Agent, or Firm* — Bachman & LaPointe, P.C.

(57) ABSTRACT

A cooling microcircuit for a turbine engine component has a first cooling passage which has at least one inlet oriented in a radially outward direction for preventing particles from entering the cooling passage and for dislodging particles which may become lodged in the at least one inlet.

13 Claims, 1 Drawing Sheet

PARTICLE RESISTANT IN-WALL COOLING PASSAGE INLET

U.S. GOVERNMENT RIGHTS

The invention was made with U.S. Government support under contract F333615-03-D-2354-0009 awarded by the U.S. Air Force. The U.S. Government has certain rights in the invention.

BACKGROUND

The present disclosure relates to a cooling passage inlet for an in-wall cooling passage for a turbine airfoil which discourages particles from entering the cooling passage.

High performance turbine airfoil cooling schemes require small cooling passages in the airfoil walls. These passages can be susceptible to blockage from particles of foreign materials present in the cooling air supply to the airfoil. Blockage of a cooling passage can result in reduced local cooling.

It is known to manufacture in-wall cooling passages using a variety of means, including refractory metal core casting (RMC). The inlet holes for these passages may be formed with small tabs extending from a main portion of an RMC core into the ceramic core of the airfoil. These holes have been axially oriented and have no special features to prevent particles from entering the cooling passage.

SUMMARY

In accordance with the instant disclosure, there is described a small in-wall cooling passage for a turbine engine component which broadly comprises a first cooling passage and said first cooling passage has at least one inlet means for preventing particles from entering said cooling passage and for dislodging particles which become lodged in the inlet means.

Further in accordance with the instant disclosure there is described a turbine engine component which broadly comprises an airfoil portion having a tip, at least one cooling passage within the wall of the airfoil portion, and each airfoil wall cooling passage having at least one inlet means for preventing particles from entering the cooling passage and for dislodging particles which may become lodged in the at least one inlet means.

Other details of the particle resistant in-wall cooling passage inlet are set forth in the following detailed description and the accompanying drawings wherein like reference numerals depict like elements.

DETAILED DESCRIPTION OF THE PREFERRED EMBODIMENT(S)

The present disclosure relates to a change in the geometry of cooling passages inlets to prevent particles from entering the cooling passages and at least partially blocking flow of the cooling fluid within the cooling passages. In accordance with the present disclosure, the inlets are skewed in a radially outward direction.

Figure 1:
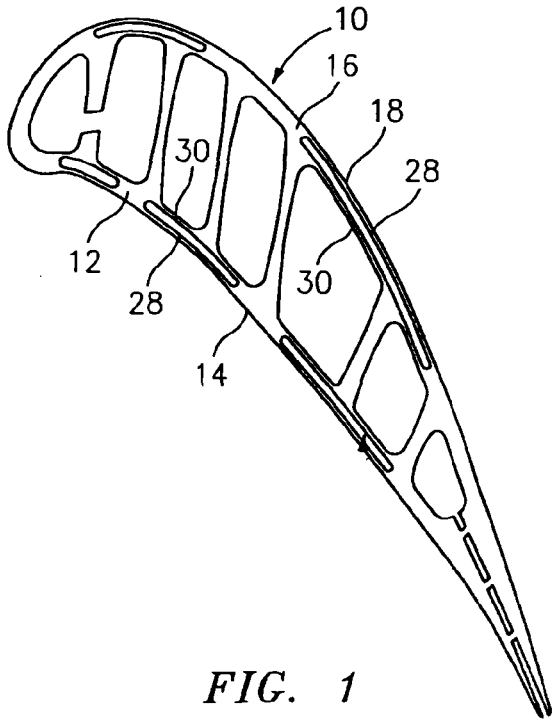
FIG. 1 is a sectional view of an airfoil portion of a turbine engine component.

FIG. 1 is a sectional view of an airfoil portion 10 of a turbine engine component such as a blade or vane. The airfoil portion has a wall 12 which form a pressure side surface 14 and a wall 16 which form a suction side surface 18. Each of the walls 12 and 16 has an outer wall 28 and the inner wall 30. Embedded within each of the walls 12 and 16 is one or more cooling passages 22.

Figure 2:
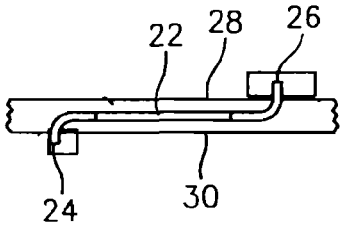
FIG. 2 is a sectional view of a cooling passage within said airfoil portion.

As shown in FIG. 2, each cooling passage 22 has one or more cooling passage inlets 24 for allowing a cooling fluid to enter the cooling passage 22 and one or more cooling passage exits 26 for allowing cooling fluid to exit the cooling passage 22 and flow over the airfoil skin outer wall 28. If desired, the cooling passages 22 may be used solely to perform in-wall cooling without having fluid flow over the outer wall. As can be seen from FIG. 2, the cooling passage 22 is located between the airfoil skin outer wall 28 and the airfoil skin inner wall 30.

Figure 3:
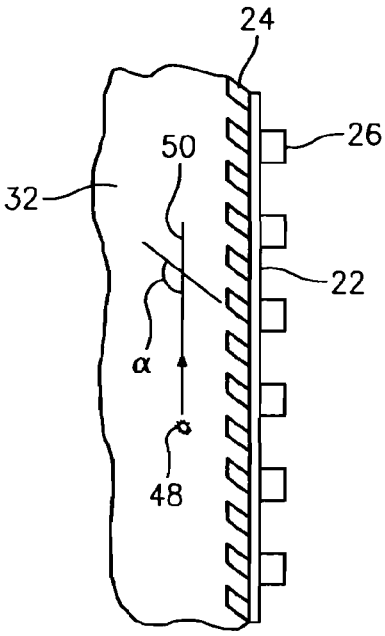
FIG. 3 is a schematic representation of the cooling passage inlet relative to a flow of cooling fluid within a cooling supply passageway.

Referring now to FIG. 3, there is shown a cooling passage 22 having a plurality of inlets 24. Each inlet 24 is radially skewed in an outward direction. As used herein, the term "outward direction" refers to the direction towards the tip of the airfoil portion. As a result, a particle 48 flowing in the cooling supply passageway 32 tends to bypass the inlets 24. Each inlet 24 may be at an angle $\alpha$ of at least 100 degrees with respect to the flow direction 50 of the cooling fluid in the cooling supply passageway 32. In a particularly useful embodiment, the angle $\alpha$ may be in the range of from 120 degrees to 160 degrees with respect to the flow direction 50.

Figure 4:
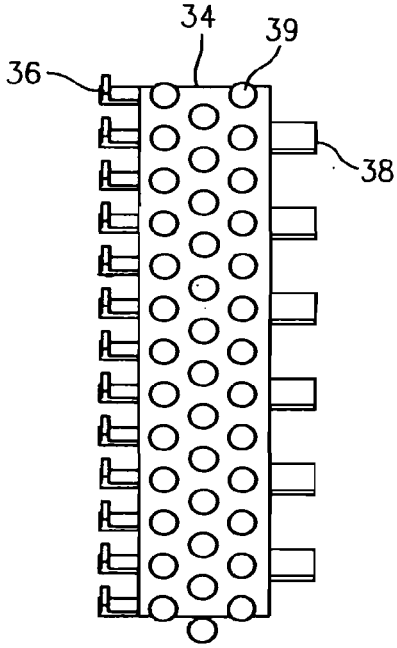
FIG. 4 is a schematic representation of a refractory metal core for forming an in-wall cooling passage having angled inlets.

The passage 22 with the radially skewed inlets 24 may be formed using a refractory metal core 34 (see FIG. 4) having appropriately angled tabs 36 for forming the inlets 24 and tabs 38 for forming the outlets 26. The refractory metal core 34 may have a plurality of holes 39 which may be used to form a plurality of flow metering features (not shown) in the passage 22.

One of the benefits of the cooling passage inlets described herein is that it discourages particles from entering cooling passages, particularly small cooling passages in the airfoil walls. This is because the particles would have to make a significant change in direction and fight the centrifugal force from a rotating blade in order to enter the passage inlets. Part durability should be increased due to a reduced potential for plugging the cooling passage. In addition, smaller flow metering features can be used, allowing for reduced component cooling flow and increased engine performance. The radially skewed inlets also will tend to throw out any particle which does become lodged.

It is apparent that there has been provided a description of a particle resistant in-wall cooling passage inlet. While the particle resistant in-wall cooling passage inlet has been described in the context of specific embodiments thereof, other unforeseeable modifications, variations, and alternatives may become apparent to those skilled in the art having read the foregoing description. Accordingly, it is intended to embrace those modifications, variations, and alternatives which fall within the broad scope of the appended claims.

What is claimed is:

1. An in-wall cooling passage for a turbine engine component comprising:

a cooling passage embedded within a wall of an airfoil portion having a tip; and said cooling passage having a plurality of inlets for allowing a cooling fluid to enter into said passage, each of said inlets being oriented in a radially outward direction towards the tip of said airfoil portion at an angle which prevents particles from entering said cooling passage and which dislodges particles which become lodged in at least one of the plurality of inlets.

2. The in-wall cooling passage of claim 1, wherein the angle is at least 100 degrees with respect to a direction of flow of cooling fluid.

3. The in-wall cooling passage of claim 2, wherein said angle is in the range of from 120 degrees to 160 degrees.

4. A turbine engine component comprising:

an airfoil portion having a tip:

at least one in-wall cooling passage within said airfoil portion; and each said in-wall cooling passage having at least one inlet which is oriented in a radially outward direction towards the tip of the airfoil portion at an angle which prevents particles from entering said cooling passage and which dislodges particles which become lodged in the at least one inlet.

5. The turbine engine component of claim 4, wherein said at least one inlet comprises a plurality of inlets oriented in said radially outward direction.

6. The turbine engine component according to claim 4, wherein each said in-wall cooling passage has an exit for allowing cooling fluid to flow from the in-wall cooling passage outside the airfoil portion.

7. The turbine engine component according to claim 4, wherein each said cooling passage has a plurality of exits for allowing cooling fluid to flow over an exterior portion of said airfoil portion.

8. The turbine engine component according to claim 4, wherein said airfoil portion has a wall having an exterior surface forming a pressure side surface and said at least one cooling passage being embedded within said wall.

9. The turbine engine component according to claim 4, wherein said airfoil portion has a wall having an exterior surface forming a suction side surface and said at least one cooling passage being embedded within said wall.

10. The turbine engine component according to claim 4, wherein each said inlet is angled at an angle of at least 100 degrees with respect to a direction of flow of cooling fluid in a cooling supply passageway.

11. The turbine engine component according to claim 10, wherein said angle is in the range of from 120 degrees to 160 degrees.

12. A turbine engine component comprising:

an airfoil portion having a tip:

at least one in-wall cooling passage within said airfoil portion; and each said in-wall cooling passage having a plurality of inlets, each of said inlets being oriented in a radially outward direction towards the tip of the airfoil portion at an angle of at least 100 degrees with respect to a direction of flow of cooling fluid in a cooling supply passageway, which angle prevents particles from entering said cooling passage and dislodges particles which become lodged in at least one of the plurality of inlets.

13. The turbine engine component of claim 12, wherein said angle is in the range of from 120 degrees to 160 degrees.

* * * * *